US010594099B2

(12) United States Patent
Harley et al.

(10) Patent No.: US 10,594,099 B2
(45) Date of Patent: Mar. 17, 2020

(54) WALL-MOUNTED NETWORK EXTENDER AND ADAPTER

(71) Applicant: ARRIS Enterprises LLC, Suwanee, GA (US)

(72) Inventors: Paul Joseph Harley, West Yorkshire (GB); Chien-Cheng Huang, Poway, CA (US); Xue-Hong Wu, New Taipei (TW); John Hausman, San Diego, CA (US); Lars Kristoffer Roberg, Linkoping (SE)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 16/227,280

(22) Filed: Dec. 20, 2018

(65) Prior Publication Data

US 2019/0207350 A1 Jul. 4, 2019

Related U.S. Application Data

(60) Provisional application No. 62/607,957, filed on Dec. 20, 2017.

(51) Int. Cl.

| | |
|---|---|
| ***H01R 13/64*** | (2006.01) |
| ***H01R 31/06*** | (2006.01) |
| ***H01R 27/02*** | (2006.01) |
| ***H01R 24/64*** | (2011.01) |
| ***H01R 13/74*** | (2006.01) |
| ***H01R 13/627*** | (2006.01) |
| *H01R 24/68* | (2011.01) |

(52) U.S. Cl.

CPC ..... *H01R 31/06* (2013.01); *H01R 13/6273* (2013.01); *H01R 13/743* (2013.01); *H01R 24/64* (2013.01); *H01R 27/02* (2013.01); *H01R 24/68* (2013.01)

(58) Field of Classification Search

CPC ..... H01R 31/06; H01R 27/02; H01R 13/719; H01R 13/6666

USPC ..... 439/376

See application file for complete search history.

(56) References Cited

U.S. PATENT DOCUMENTS 5,466,165 A * 11/1995 Boesel ..... H01R 13/6666 439/142
6,747,859 B2 * 6/2004 Walbeck ..... H01R 13/719 361/111
2009/0109638 A1 4/2009 Kim

FOREIGN PATENT DOCUMENTS

CN 203481569 U 3/2014
CN 106299929 A 1/2017
(Continued)

OTHER PUBLICATIONS

PCT International Search Report & Written Opinion, Re: Application No. PCT/US2018/066759, dated Feb. 28, 2019.

*Primary Examiner* — Jean F Duverne
(74) *Attorney, Agent, or Firm* — Bart A. Perkins

(57) ABSTRACT

A power module may be attached to and detached from a network extender. The power module may include one or more power connectors that are specific to one or more countries/regions. The power module may include one or more other interfaces (e.g., Ethernet port, etc.). The power module may include a power connector and a male local area network connector on a first surface. The power module may include a local area network port on a second surface, wherein the local area network port is conductively connected to the male local area network connector via a local area network port access.

11 Claims, 16 Drawing Sheets

(56) References Cited

FOREIGN PATENT DOCUMENTS

| | | | |
|---|---|---|---|
| DE | 202012104390 | U1 | 1/2013 |
| EP | 2928027 | A1 | 10/2015 |
| JP | H08 8952 | A | 1/1996 |

* cited by examiner

WALL-MOUNTED NETWORK EXTENDER AND ADAPTER

CROSS REFERENCE TO RELATED APPLICATION

This application is a non-provisional application claiming the benefit of U.S. Provisional Application Ser. No. 62/607,957, entitled "Wall-Mounted Network Extender and Adapter," which was filed on Dec. 20, 2017, and is incorporated herein by reference in its entirety.

TECHNICAL FIELD

This disclosure relates to a wall-mounted network extender and adapter.

BACKGROUND

Typically, the design of a network extender (e.g., Wi-Fi extender) may be such that the network extender can operate while being supported by a horizontal base (i.e., a desk, table, shelf, etc.) or while being supported by a means for mounting or attaching the network extender to a vertical surface (e.g., the network extender may be plugged into a wall power outlet). However, thermal constraints may require that the network extender operate while positioned in a vertical orientation. Therefore, certain interfaces (e.g., Ethernet port) of the network extender may be obscured or blocked depending upon whether the network extender is supported by a horizontal surface/base or secured to a vertical surface. For example, different regions/countries may provide different AC power connectors, and the AC power connector of a network extender may not match the AC power connectors provided in each region/country. It is desirable to provide an improved network extender that may support operability at various orientations.

BRIEF DESCRIPTION OF THE DRAWINGS

Like reference numbers and designations in the various drawings indicate like elements.

DETAILED DESCRIPTION

It is desirable to provide an improved network extender that may support operability at various orientations. In embodiments, a power module may be designed such that the power module may be attached to and detached from a network extender. The power module may include one or more power connectors that are specific to one or more countries/regions. The power module may include one or more other interfaces (e.g., Ethernet port, etc.). The power module may include a power connector and a male local area network connector on a first surface. The power module may include a local area network port on a second surface, wherein the local area network port is conductively connected to the male local area network connector via a local area network port access.

Figure 1:
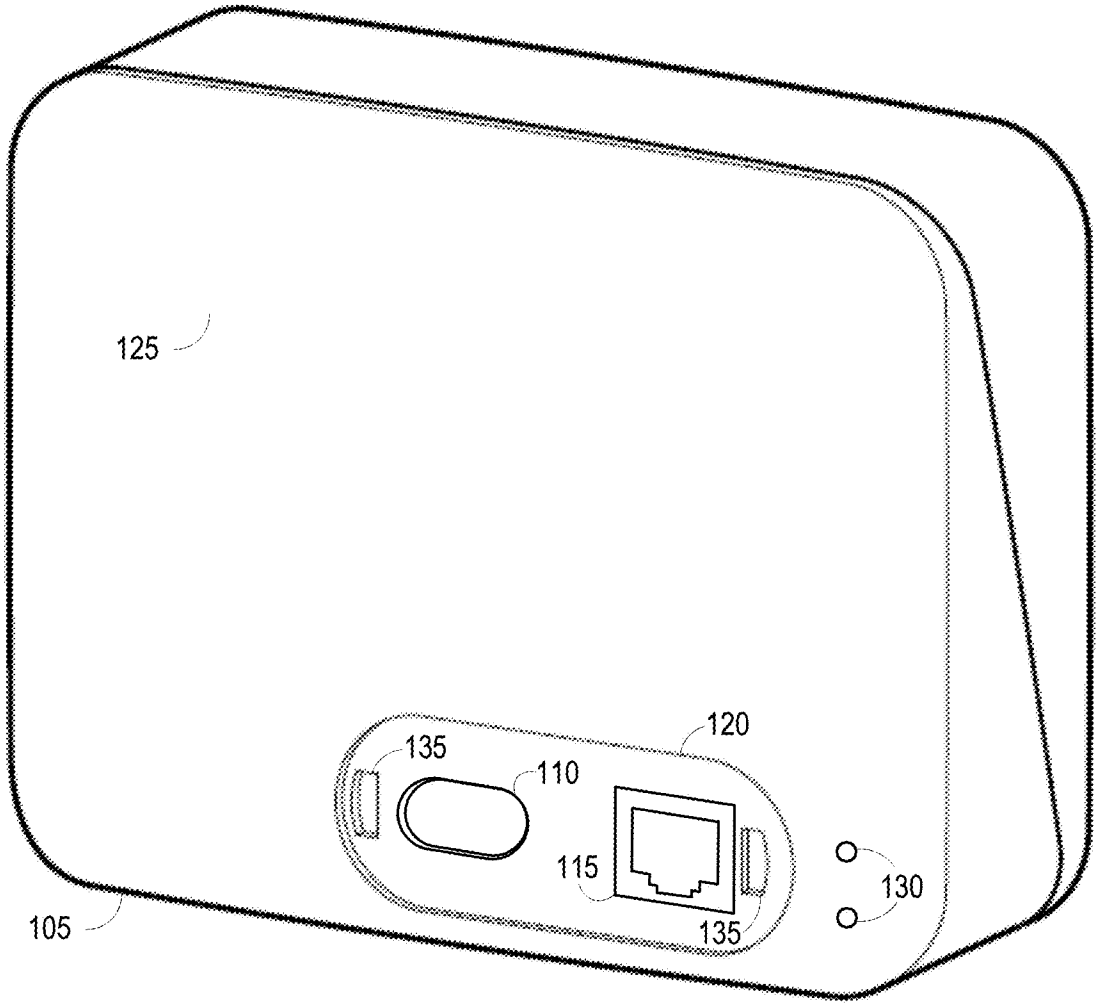
FIG. 1 shows an example illustration of a rear perspective view of a network extender.

FIG. 1 shows an example illustration of a rear perspective view of a network extender 105. The network extender 105 is shown in an upright position. The network extender 105 may be supported by a horizontal surface or may be mounted to a vertical surface. In embodiments, a bottom surface of the network extender 105 may include one or more legs or other surfaces configured to provide stability to the network extender 105 when the network extender 105 is supported in an upright position by a horizontal surface. The front surface of the network extender 105 may include one or more status lights (e.g., LEDs) and one or more buttons (e.g., a WPS (Wi-Fi protected setup) button). The side surface of the network extender 105 may include a power switch and a recessed reset button.

In embodiments, the network extender 105 may include a power port 110 configured to accept a power connector and a LAN (local area network) port 115 configured to accept a LAN connector (e.g., an Ethernet port configured to accept an Ethernet connector). The power port 110 and LAN port 115 may be located within a connector section 120 of the network extender 105. The connector section 120 may be a recessed section of a rear surface 125 of the network extender 105. The rear surface 125 of the network extender 105 may include one or more light indicators 130 (e.g., light emitting diodes (LEDs)) to provide an indication of a current status of the network extender 105 (e.g., status of the LAN to which the network extender 105 is connected).

In embodiments, one or more clip openings 135 may be located on the rear surface of the network extender 105.

Figure 2:
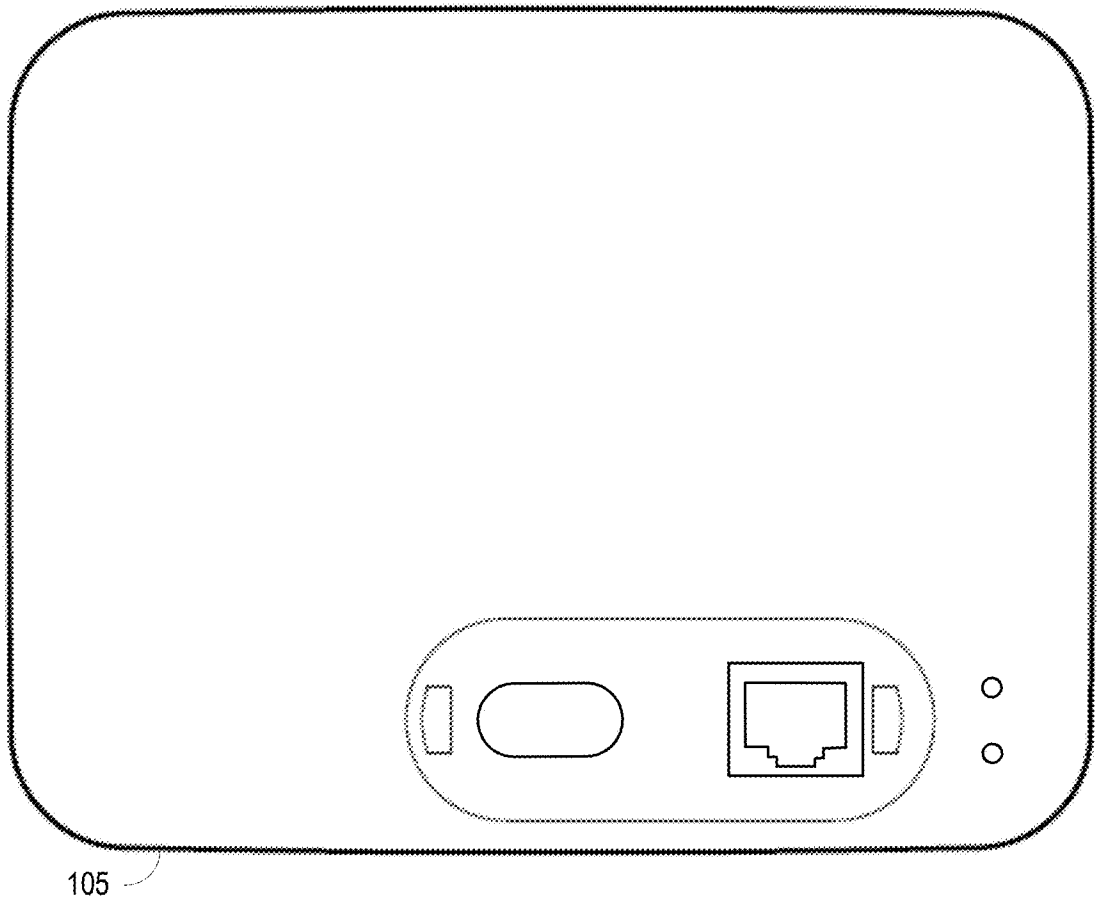
FIG. 2 shows an example illustration of a rear view of the network extender.

FIG. 2 shows an example illustration of a rear view of the network extender 105.

Figure 3:
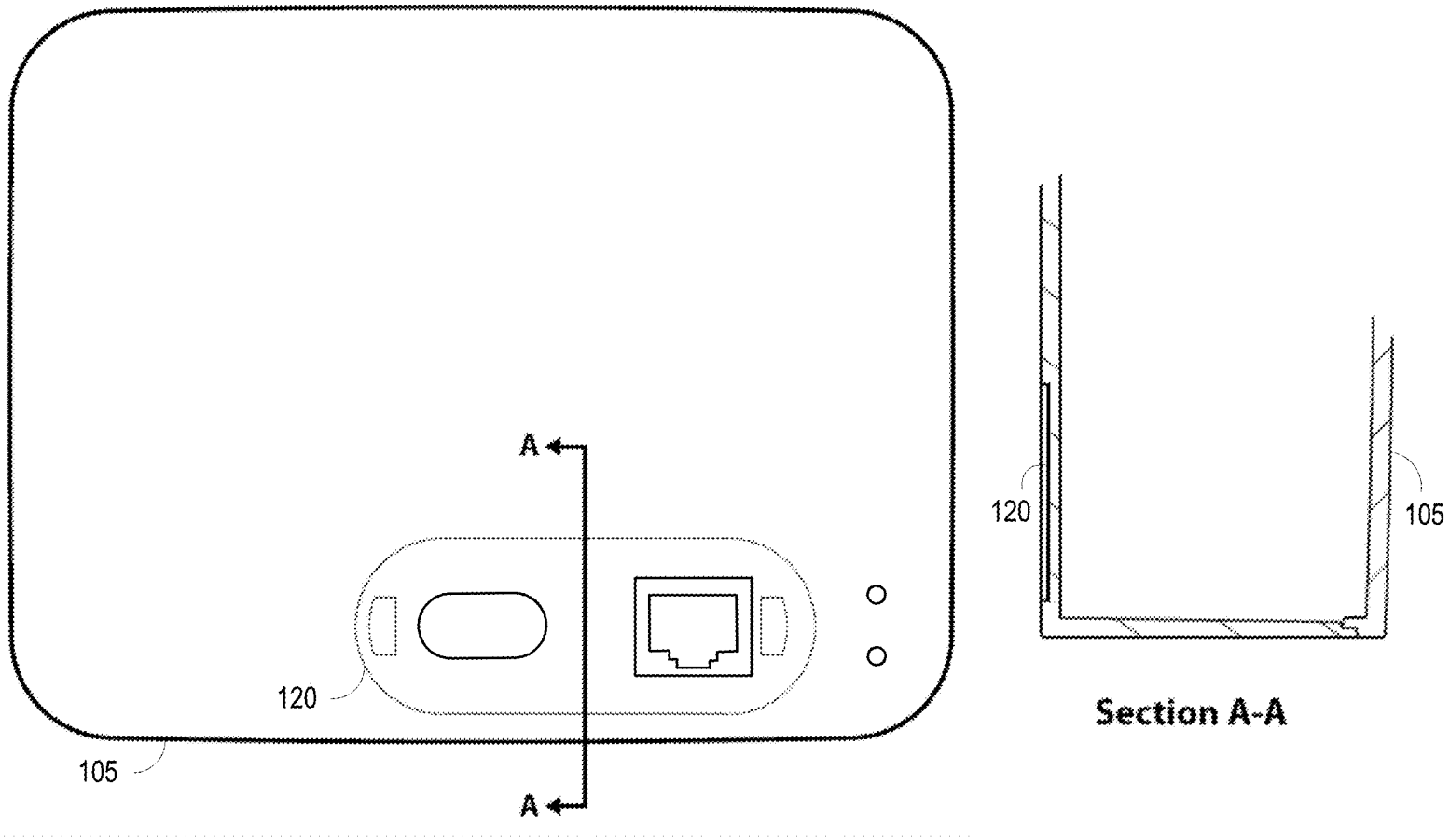
FIG. 3 shows an example illustration of a cross-sectional side view of the network extender.

FIG. 3 shows an example illustration of a cross-sectional side view of the network extender 105. The cross-section A-A shows the recessed connector section 120 of the network extender 105.

Figure 4:
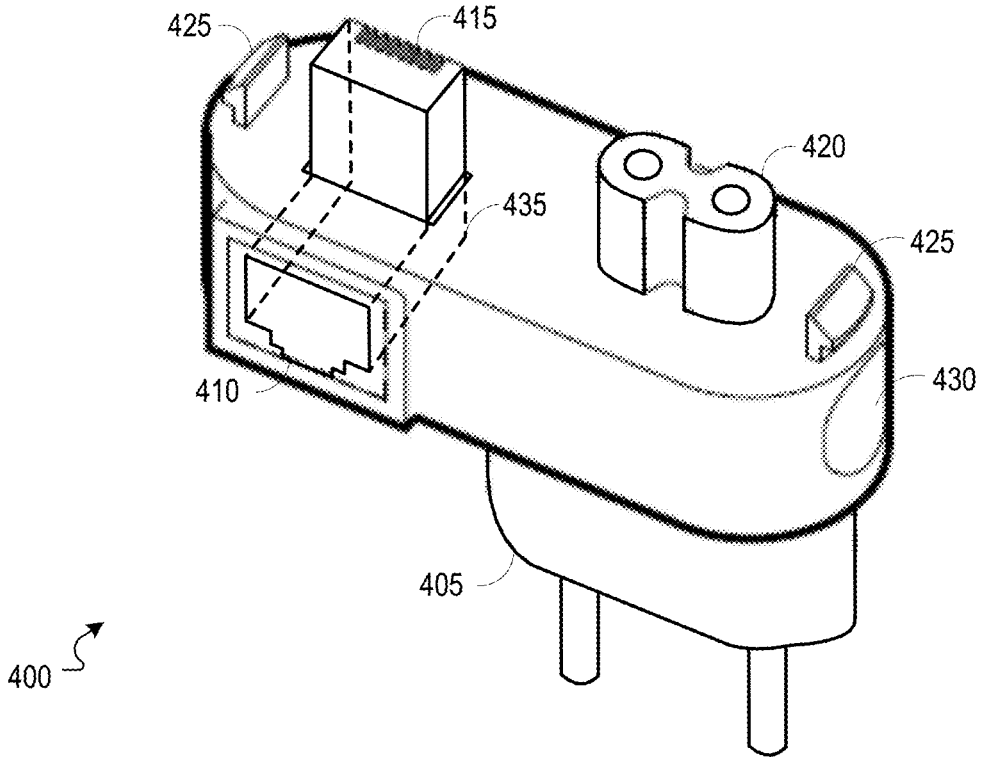
FIG. 4 shows an example illustration of a front perspective view of a power module.

FIG. 4 shows an example illustration of a front perspective view of a power module 400. In embodiments, the power module 400 may include a power adapter 405 (e.g., AC connector) that corresponds with a certain region/country-specific power outlet. The power module 400 may include a local area network port 410 (e.g., an Ethernet port) at a first surface (e.g., the bottom of the power module 400) and a male local area network connector 415 (e.g., a male Ethernet connector) on a second surface (e.g., the front surface of the power module 400).

In embodiments, the power module 400 may include a power connector 420. The power connector 420 may be on the second surface (e.g., the front surface of the power module 400). The power module 400 may include a flexible clip 425 at each end. Each flexible clip 425 may include a finger grip form 430. A flexible clip 425 may be moved toward the center of the power module 400 in response to a force being applied to a corresponding finger grip form 430.

The local area network port 410 on the bottom of the power module 400 may be conductively connected to the male local area network connector 415 via a ninety-degree local area network port access 435 (the ninety-degree local area network port access 435 is shown in broken lines). For example, within the power module 400, the ninety-degree local area network port access may pass from the bottom of the power module 400 to a front surface of the power module 400. The ninety-degree local area network port access may be an Ethernet port access.

It should be understood that the local area network port 410 may be an Ethernet port and that the male local area network connector 415 may be a male Ethernet connector.

Figure 5:
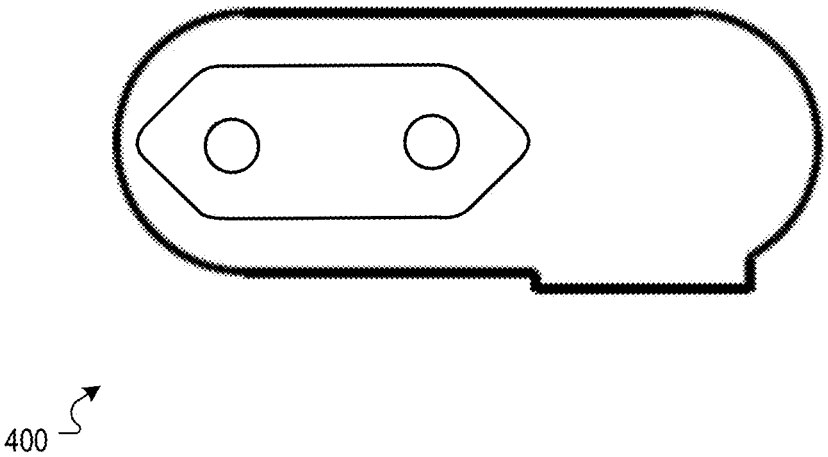
FIG. 5 shows an example illustration of a rear view of a power module.

FIG. 5 shows an example illustration of a rear view of a power module 400.

Figure 6:
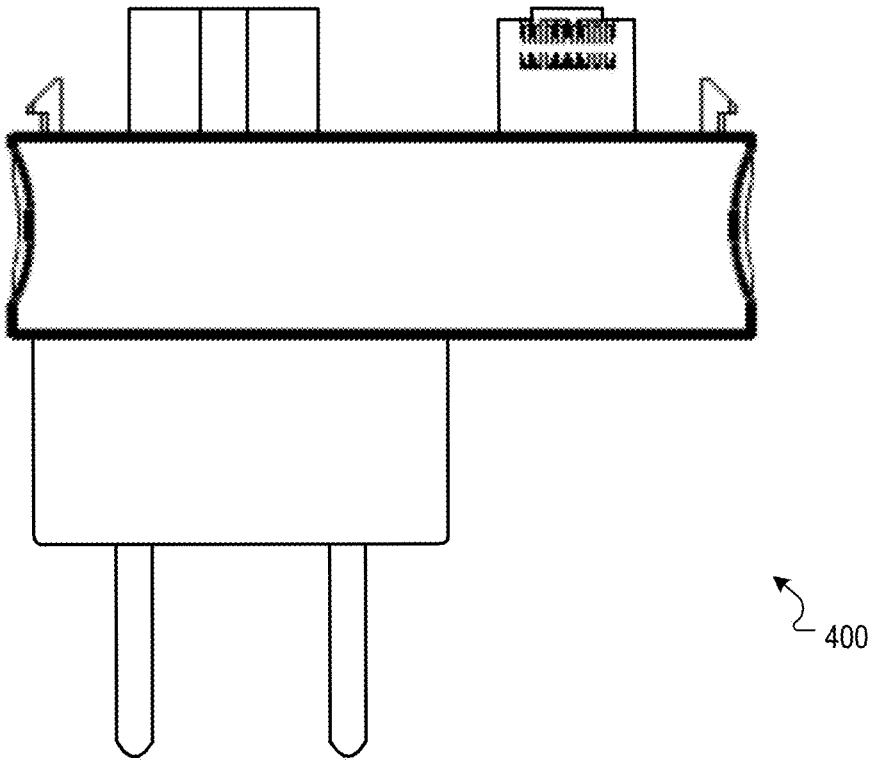
FIG. 6 shows an example illustration of a top view of a power module.

FIG. 6 shows an example illustration of a top view of a power module 400.

Figure 7:
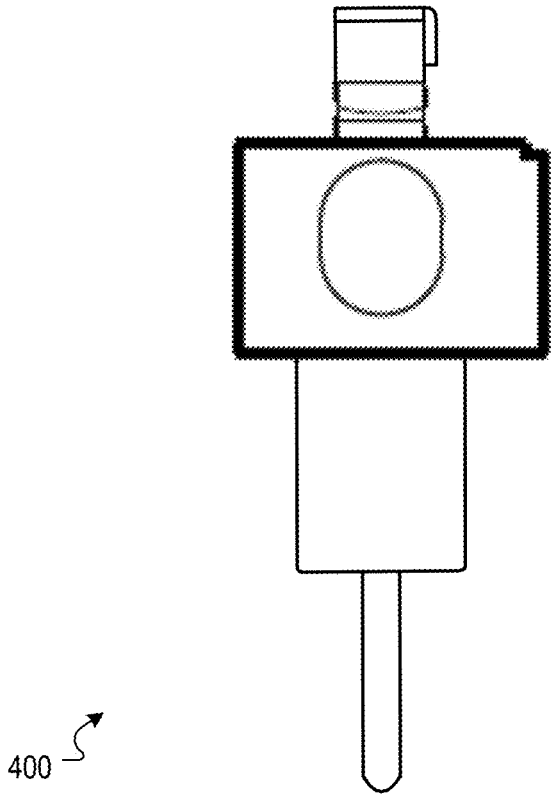
FIG. 7 shows an example illustration of a left side view of a power module.

FIG. 7 shows an example illustration of a left side view of a power module 400.

Figure 8:
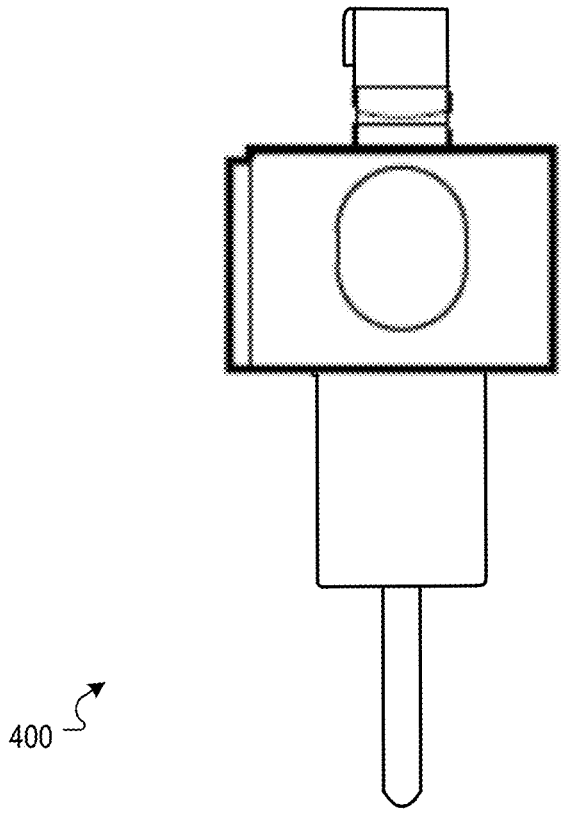
FIG. 8 shows an example illustration of a right side view of a power module.

FIG. 8 shows an example illustration of a right side view of a power module 400.

Figure 9:
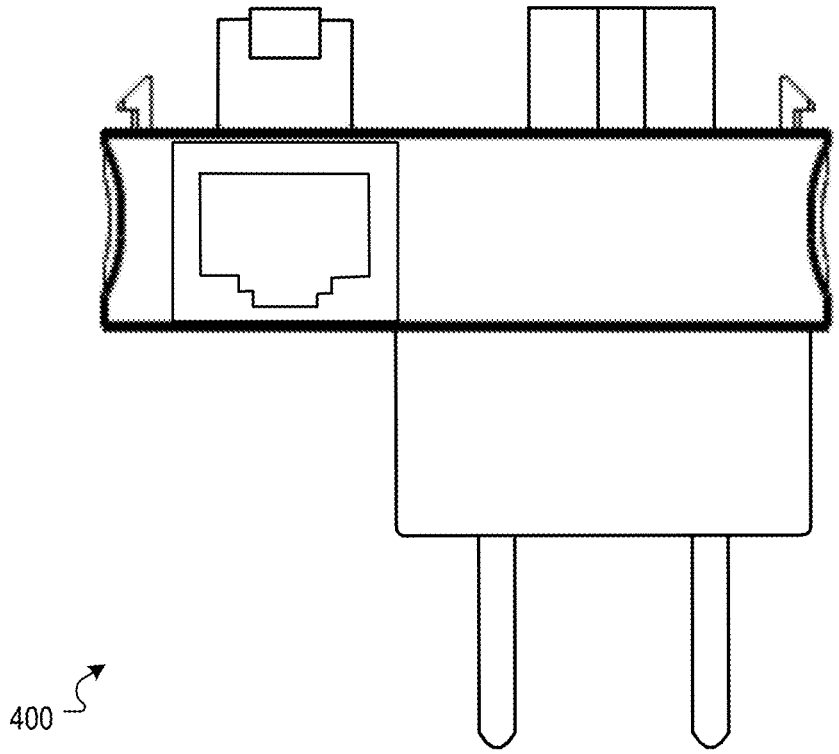
FIG. 9 shows an example illustration of a bottom view of a power module.

FIG. 9 shows an example illustration of a bottom view of a power module 400.

Figure 10:
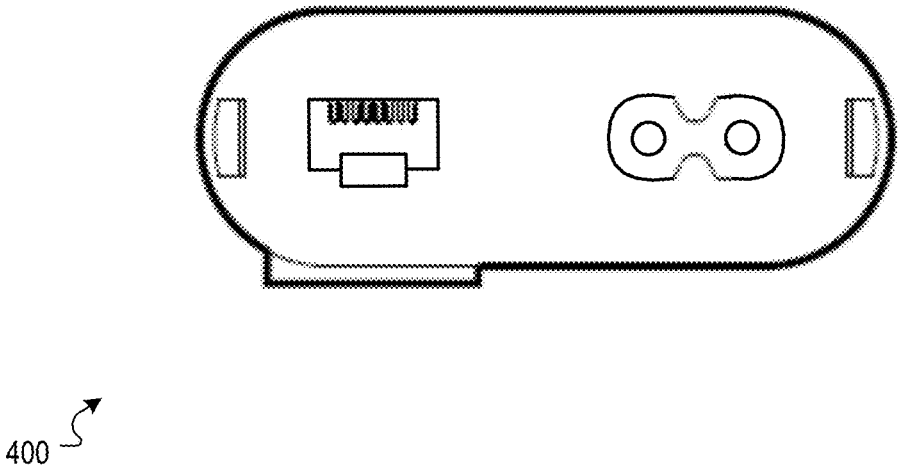
FIG. 10 shows an example illustration of a front view of a power module.

FIG. 10 shows an example illustration of a front view of a power module 400.

Figure 11:
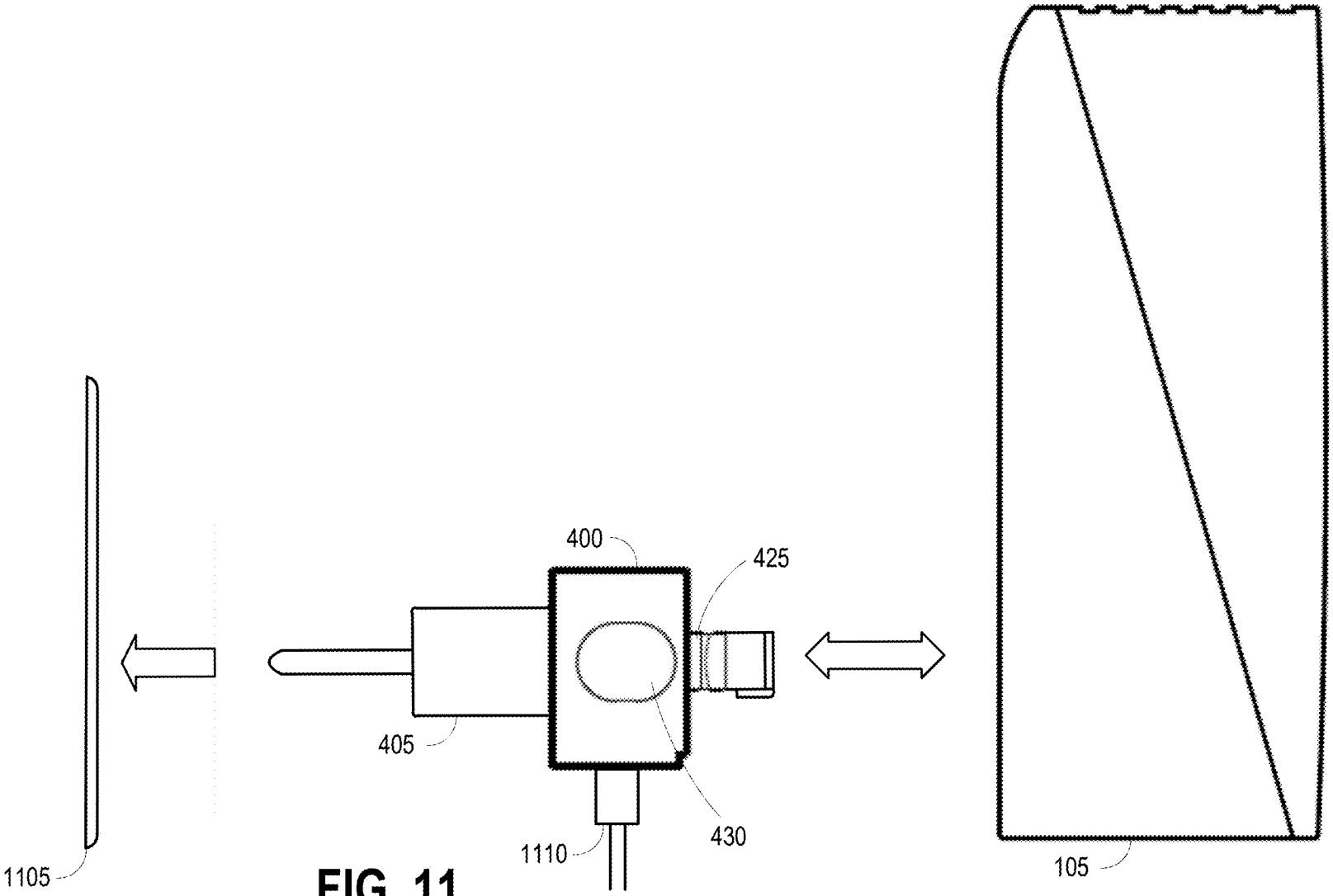
FIG. 11 shows an example illustration of a power module coupled to a network extender.

FIG. 11 shows an example illustration of a power module 400 that may be coupled to a network extender 105. In embodiments, the power module 400 may be coupled to the network extender 105, and the power adapter 405 of the power module 400 may be plugged into a power outlet 1105. For example, the power module 400 may include a power adapter 405 (e.g., AC connector) that corresponds with a certain region/country-specific power outlet. One or more ports or connectors of the network extender 105 (e.g., a power port 110 of FIG. 1, a LAN port 115 of FIG. 1, etc.) may be plugged into one or more ports or connectors associated with the power module 400 (e.g., a male local area network connector 415 of FIG. 4, a power connector 420 of FIG. 4, etc.). The network extender 105 is shown as being mounted to a vertical surface (e.g., through a connection to the power outlet 1105) and in an upright position.

In embodiments, within the power module 400, a ninety-degree local area network port access may pass from the bottom of the power module 400 to a front surface of the power module 400. For example, the power module 400 may include a local area network port (e.g., local area network port 410 of FIG. 4) at the bottom of the power module 400 and a local area network connector (e.g., a male local area network connector 415) on the front surface of the power module 400. A local area network cord 1110 (e.g., an Ethernet cord) may be inserted into the local area network port located on the bottom of the power module 400, and the male local area network connector of the power module 400 may be inserted into a local area network port located on the network extender 105. The local area network port on the bottom of the power module 400 may be conductively connected to the male local area network connector on the front surface of the power module 400.

In embodiments, the power module 400 may include a power connector (e.g., a power connector 420) and a local area network connector (e.g., a male local area network connector 415) on the front surface of the power module 400. The power connector and local area network connector of the power module 400 may be spaced according to a spacing of a power port (e.g., a power port 110) and local area network port (e.g., a LAN port 115) on the network extender 105. For example, the power connector and local area network connector may be positioned on the front surface of the power module 400 such that the power connector mates with the power port of the network extender 105 and the local area network connector mates with the local area network port of the network extender 105 when the power module 400 is coupled with the network extender 105.

The power module 400 may include a flexible clip 425 at each end. The power module 400 may be inserted into a recessed portion (e.g., connector section 120 of FIG. 1) of the network extender 105 such that each flexible clip 425 is inserted into a corresponding clip opening (e.g., clip opening 135 of FIG. 1) of the network extender 105. Each flexible clip 425 may include a finger grip form 430. Pressing and depressing the finger grip form 430 may act to engage/disengage a hook at an opposing end of the corresponding flexible clip 425 to/from an interior surface of the clip openings (e.g., clip opening 135) located on the rear surface of the network extender 105.

The power module 400 may be coupled to the network extender 105 in order to mount the network extender 105 to a vertical surface by plugging the power module 400 into the power outlet 1105. The power module 400 may be removed from the network extender 105 in order to stand the network extender 105 in an upright position on a horizontal surface.

To remove the power module 400 from the network extender 105, each finger grip form 430 may be depressed, thereby disengaging one or more hooks of each flexible clip 425 from the interior of one or more clip openings (e.g., clip opening 135) of the network extender 105, and the power module 400 may be disconnected from the network extender 105.

While the power module 400 is described herein as being coupled to a network extender 105, it should be understood that the power module 400 may be coupled to any device (e.g., customer premise equipment (CPE) device) having a power port and/or local area network port.

Figure 12:
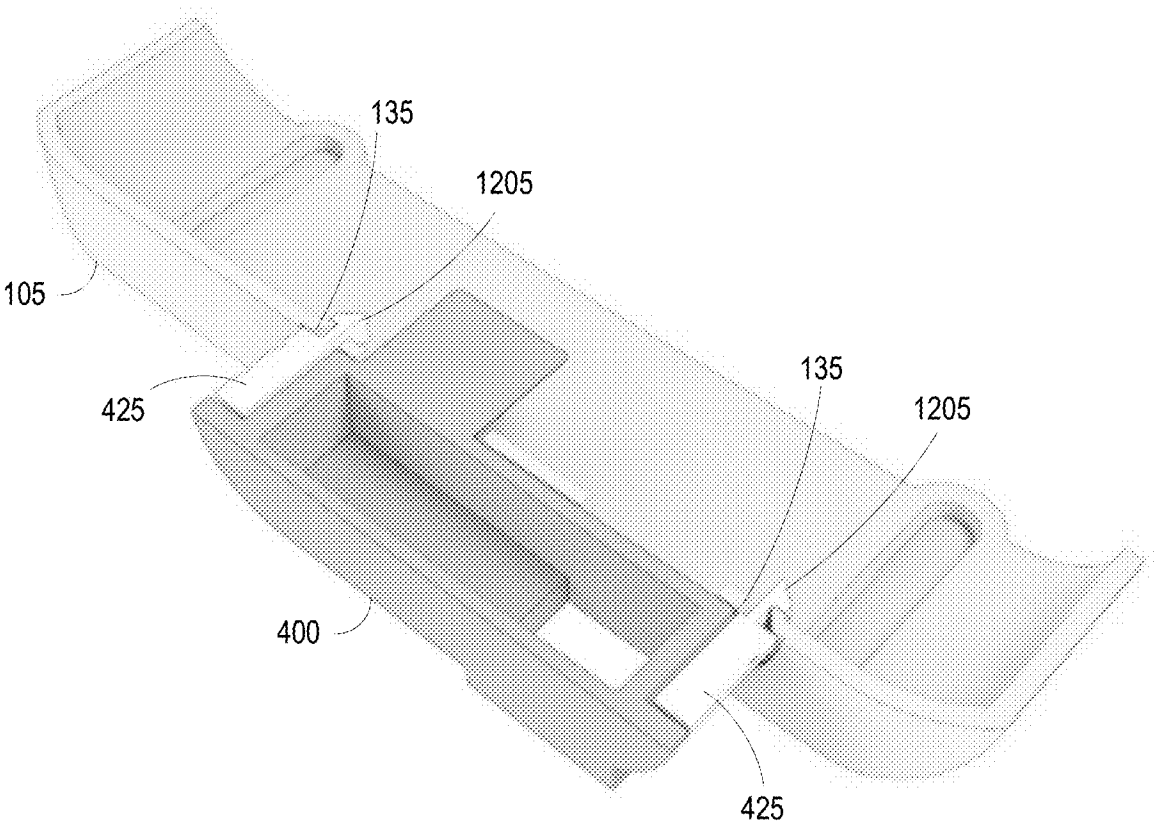
FIG. 12 shows an example illustration of a cut-away of a power module coupled to a network extender.

FIG. 12 shows an example illustration of a cut-away of a power module 400 coupled to a network extender 105. When the power module 400 is coupled to the network extender 105, each flexible clip 425 may be in an engaged position. In embodiments, each respective flexible clip 425 may be locked securely into place when a ramp 1205 of the respective flexible clip 425 passes through a corresponding clip opening 135. Each flexible clip 425 may be designed to resist deflection (e.g., each flexible clip 425 may be nylon filled to resist the force of pulling the network extender 105 away from an AC outlet).

Figure 13:
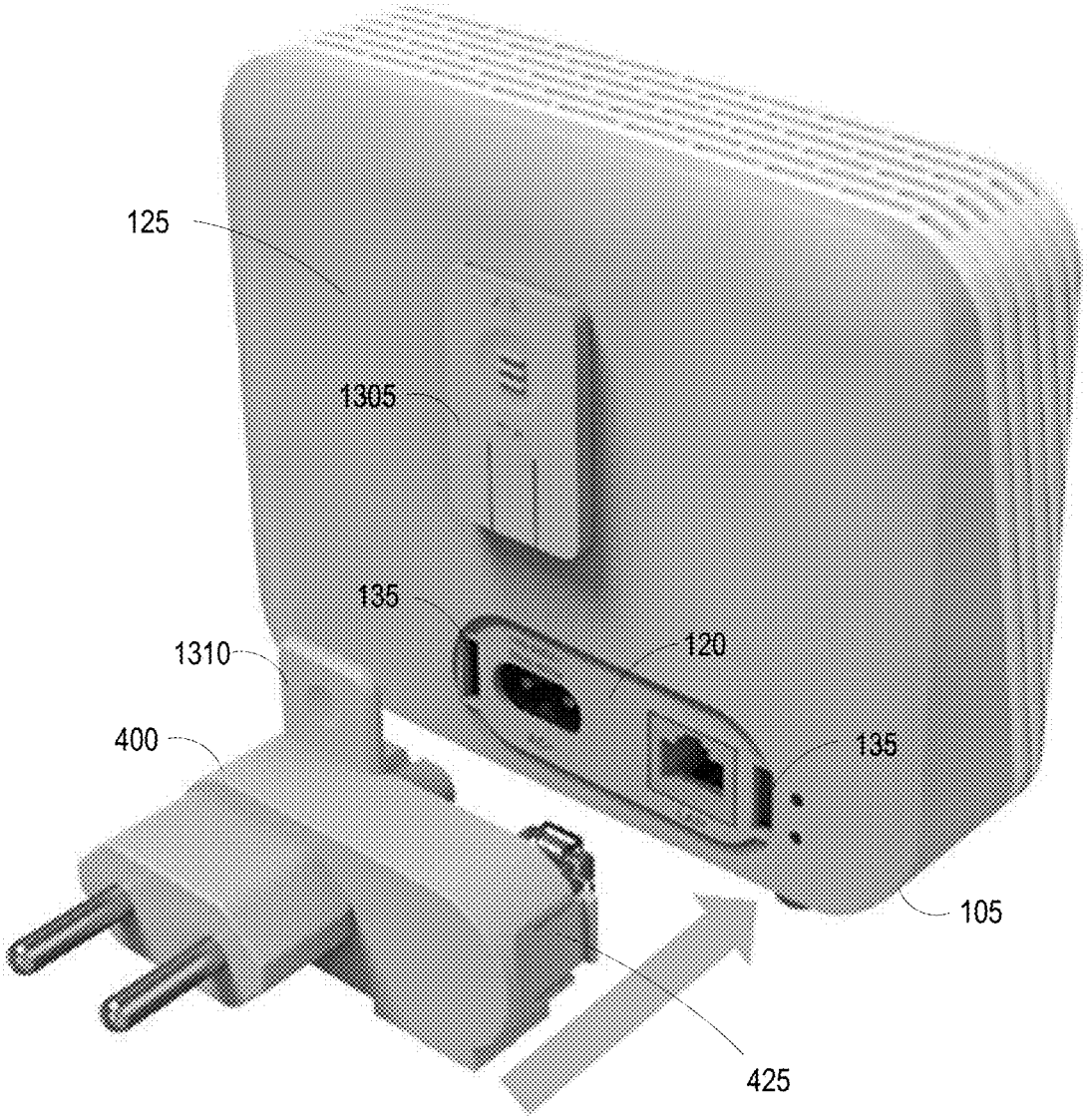
FIG. 13 shows an example illustration of a power module coupled to a network extender using an alternative connection mechanism.

FIG. 13 shows an example illustration of a power module 400 that may be coupled to a network extender 105 using an alternative connection mechanism. In embodiments, the network extender 105 may include a sliding clip 1305 that may be moved to hold the power module 400 in place.

In embodiments, two clip openings 135 may be located on the rear surface 125 of the network extender 105. The two clip openings 135 may be dimensioned and positioned so that each clip opening 135 may accept a flexible clip 425 associated with the power module 400 when the power module 400 is coupled to the network extender 105.

In embodiments, the power module 400 may include a flexible clip 425 at each end. The power module 400 may be inserted into the recessed connector section 120 of the network extender 105 such that each flexible clip 425 is inserted into a corresponding clip opening 135. Pushing and/or pulling the power module 400 may act to engage/disengage a hook at an opposing end of a flexible clip 425 to/from an interior surface of the corresponding clip opening 135.

In embodiments, the power module 400 may include an extension 1310 and the rear surface 125 of the network extender 105 may include a sliding clip 1305. The sliding clip 1305 may be slid up/down in a vertical direction when the network extender is in an upright position. When the power module 400 is inserted into the recessed connector section 120 of the network extender 105, the sliding clip 1305 may be slid down to cover the extension 1310 of the power module 400, thereby securing the power module 400 to the network extender 105.

Figure 14:
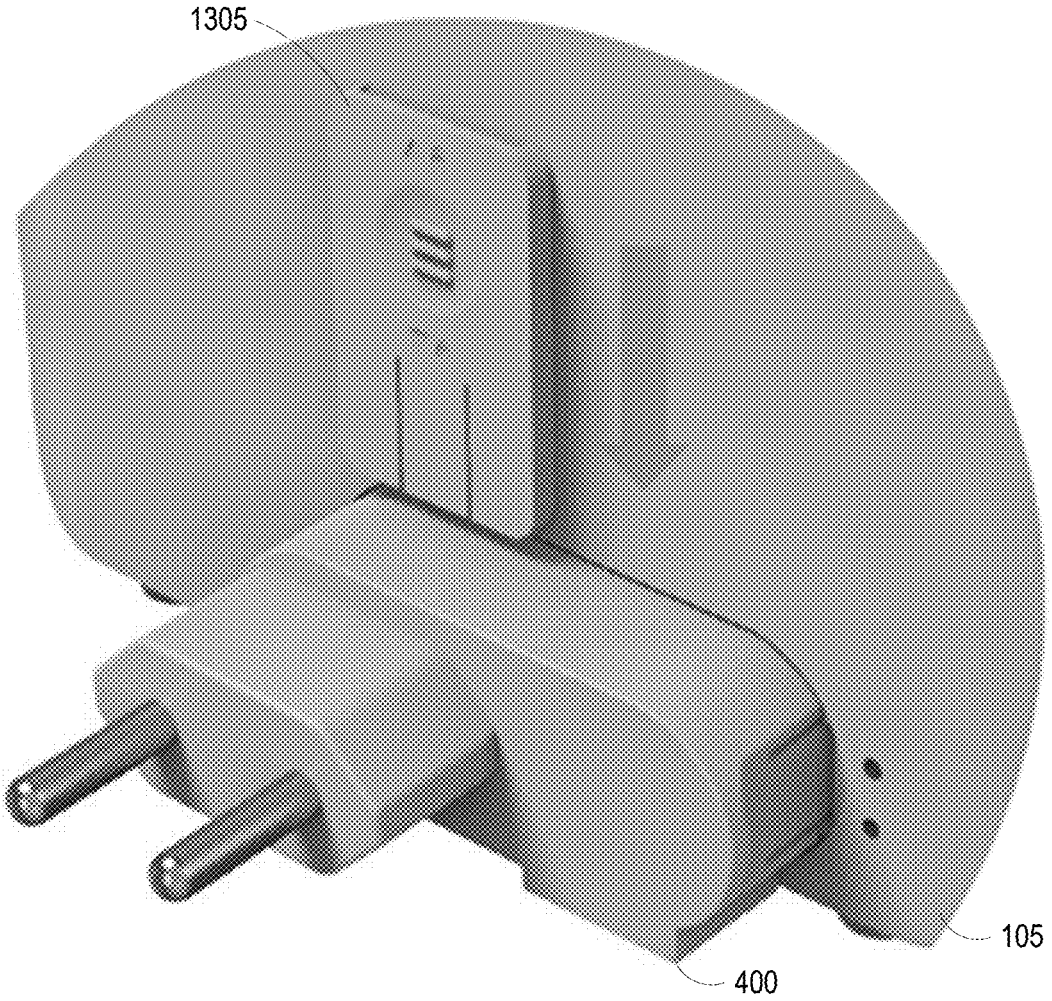
FIG. 14 shows an example illustration of a power module coupled to a network extender, wherein the power module is secured by a sliding clip.

FIG. 14 shows an example illustration of a power module 400 coupled to a network extender 105, wherein the power module 400 is secured by a sliding clip 1305. To secure the power module 400, the sliding clip 1305 may be positioned to cover an extension (e.g., extension 1310 of FIG. 13) of the power module 400. The sliding clip 1305 is shown in an engaged position with respect to an extension of the power module 400. The sliding clip 1305 may be lowered such that the extension of the power module 400 is covered, thereby securing the power module 400 against the network extender 105.

Figure 15:
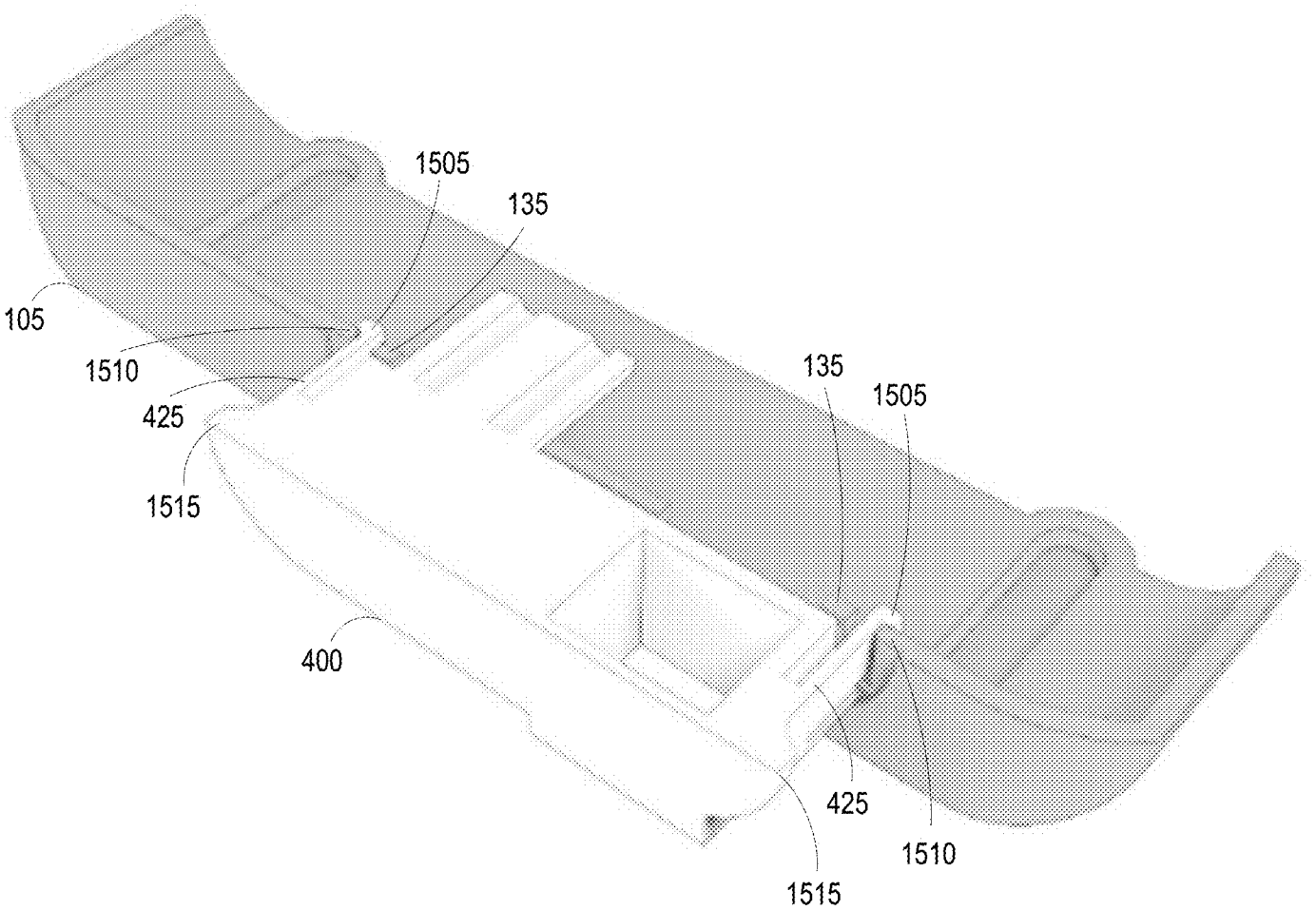
FIG. 15 shows an example illustration of a cut-away of a power module connected to a network extender by way of an alternative connection mechanism.

FIG. 15 shows an example illustration of a cut-away of a power module 400 connected to a network extender 105 by way of an alternative connection mechanism. When connected to the network extender 105 by way of the alternate connection mechanism, one or more flexible clips 425 of the power module 400 may be engaged. In embodiments, a tab 1505 of each flexible clip 425 and an interior edge 1510 of each clip opening 135 may be rounded so that upon insertion of the flexible clips 425 into the clip openings 135, only a soft locking occurs. For example, the tabs 1505 may hold the flexible clips 425 in position with respect to the interior surface of the clip openings 135.

In embodiments, the power module 400 may include one or more flared grips 1515 to allow a user to firmly and securely grip the power module 400 when engaging and/or disengaging the power module 400 from the network extender 105.

In embodiments, the flexible clips 425 of the power module 400 may be disengaged from the network extender 105. For example, the flexible clips 425 may deflect utilizing the spring of the material (e.g., plastic) rather than a separate part. When a sliding clip (e.g., 1305 of FIG. 13) is in a disengaged position, the power module 400 may be inserted into or removed from the network extender 105 without any additional action of pressing/depressing the flexible clips 425.

Figure 16:
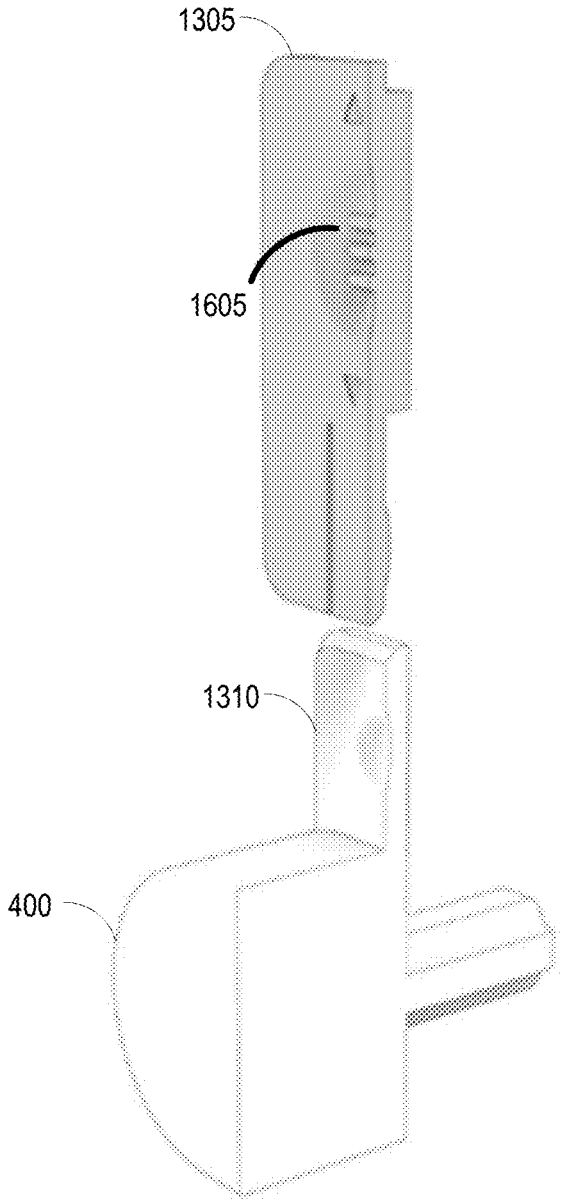
FIG. 16 shows an example illustration of a cut-away view showing a sliding clip in a disengaged position with respect to an extension of a power module.

FIG. 16 shows an example illustration of a cut-away view showing a sliding clip 1305 in a disengaged position with respect to an extension 1310 of a power module 400. The sliding clip 1305 may be raised such that the extension 1310 of the power module 400 is uncovered, thereby allowing the power module 400 to be easily removed from a network extender (e.g., network extender 105 of FIG. 1). The surface of the sliding clip 1305 may include a finger grip 1605 (e.g., depression and/or grooves) to provide a gripping surface. It is, of course, not possible to describe every conceivable combination of components or methodologies for purposes of describing the claimed subject matter, but one of ordinary skill in the art can recognize that further combinations and permutations of such matter are possible. Accordingly, the claimed subject matter is intended to embrace all such alterations, modifications and variations that fall within the spirit and scope of the appended claims.

We claim:

1. A power module comprising:

a power adapter;

a power connector;

a local area network port, wherein the local area network port is located on a first surface of the power module, wherein the first surface of the power module comprises a bottom surface of the power module when the power adapter is plugged into a power outlet; and a male local area network connector, wherein the male local area network connector is located on a second surface of the power module, and wherein the male local area network connector is conductively connected to the local area network port via a ninety-degree local area network port access, wherein the second surface of the power module comprises a front surface of the power module, the front surface of the power module facing away from the power outlet.

2. The power module of claim 1, further comprising:

one or more flexible clips.

3. The power module of claim 2, wherein the one or more flexible clips are spaced according to a position of one or more clip openings of a customer premise equipment device.

4. The power module of claim 2, wherein each of the one or more flexible clips comprises a ramp that may be passed through a clip opening of a customer premise equipment device.

5. The power module of claim 2, wherein each of the one or more flexible clips comprises a rounded tab that may be passed through a clip opening of a customer premise equipment device.

6. The power module of claim 1, further comprising:

an extension.

7. The power module of claim 6, wherein the extension is dimensioned such that a sliding clip of a customer premise equipment device may cover at least a portion of the extension when the sliding clip is in an engaged position.

8. The power module of claim 1, wherein the power connector and the male local area network connector are spaced according to a location of a power port and a local area network port of a customer premise equipment device.

9. The power module of claim 1, wherein the local area network port comprises an Ethernet port.

10. The power module of claim 1, wherein the male local area network connector comprises a male Ethernet connector.

11. The power module of claim 1, wherein the power connector is located on the second surface of the power module.

* * * * *